United States Patent [19]

Schneider

[11] Patent Number: 4,710,009

[45] Date of Patent: Dec. 1, 1987

[54] PHOTOTECHNICAL APPARATUS OF VERTICAL ARRANGEMENT FOR CONTINUOUS DEVELOPMENT OF PHOTOGRAPHIC MATERIALS, PARTICULARLY PHOTOGRAPHIC PLATES

[76] Inventor: László Schneider, Néphadsereg u. 13, Budapest, V., Hungary

[21] Appl. No.: 774,591

[22] PCT Filed: Dec. 20, 1984

[86] PCT No.: PCT/HU84/00064

§ 371 Date: Aug. 22, 1985

§ 102(e) Date: Aug. 22, 1985

[87] PCT Pub. No.: WO85/02919

PCT Pub. Date: Jul. 4, 1985

[30] Foreign Application Priority Data

Dec. 23, 1983 [HU] Hungary ..... 4444/83

[51] Int. Cl.[4] ..... G03D 3/02; G03D 3/08

[52] U.S. Cl. ..... 354/322; 354/324; 226/189

[58] Field of Search ..... 354/316, 320, 321, 322, 354/324; 134/64 P, 122 P; 226/189

[56] References Cited

U.S. PATENT DOCUMENTS

| | | | |
|---|---|---|---|
| 3,345,928 | 10/1967 | Krehbiel | 354/321 |
| 3,760,705 | 9/1973 | Miller | 354/322 |
| 4,002,280 | 1/1977 | Coleman et al. | 226/189 |
| 4,034,389 | 7/1977 | Huss | 354/322 |
| 4,174,901 | 11/1979 | Takita et al. | 354/322 |
| 4,230,404 | 10/1980 | Huss | 226/189 |
| 4,307,831 | 12/1981 | Hope et al. | 226/189 |
| 4,416,529 | 11/1983 | Kastl | 354/320 |

FOREIGN PATENT DOCUMENTS

| | | |
|---|---|---|
| 2740650 | 1/1979 | Fed. Rep. of Germany . |
| 953584 | 3/1964 | United Kingdom . |
| 1072782 | 6/1967 | United Kingdom . |
| 1389492 | 4/1975 | United Kingdom . |
| 1402354 | 8/1975 | United Kingdom . |

*Primary Examiner*—A. A. Mathews

*Attorney, Agent, or Firm*—Michael N. Meller

[57] ABSTRACT

An apparatus for continuous development of photographic materials, particularly photographic plates, comprising between an input and an output terminal a series of a least two modules of vertical arrangement and a forwarding unit between each pair of the modules wherein each module includes passing rolls arranged along three vertical columns and a reversing roll in the lower part of the module connected to two of the columns, characterized in that the modules are arranged closely adjacent and separated by walls of cross-section forming in both modules a line crossing the tangential plane to the passing rolls which are arranged in two adjacent columns separated by the walls.

14 Claims, 3 Drawing Figures

PHOTOTECHNICAL APPARATUS OF VERTICAL ARRANGEMENT FOR CONTINUOUS DEVELOPMENT OF PHOTOGRAPHIC MATERIALS, PARTICULARLY PHOTOGRAPHIC PLATES

BACKGROUND OF THE INVENTION

The invention relates to a phototechnical apparatus of vertical arrangement for continuous development of photographic materials, particularly photographic plates, comprising between an input and an output terminal a series of at least two modules of vertical arrangement and a forwarding unit between each pair of modules, wherein each module includes passing rolls arranged along three vertical columns and a reversing roll in the lower part of the module connected to two of the columns. The invented apparatus renders possible the continuous development of different photographic materials such as photographic plates and flat films in a way whereby space and chemicals can be saved.

A part of the known apparata for continuous development of photographic materials is constructed on the basis of modules. The chemicals needed for different development operations are placed in different vessels constituting modules, wherein cylindrical rolls forward the photographic material. The number of rolls, the length of the path and the speed of travel in the module defined by the rolls determine the time during which the material to be developed resides in the module. During this time the chemical medium of required quality and heated to a required temperature ensures the chemical processes needed for development. The chemicals are preferably circulated in modules and they are generally renewed by means of regenerating media.

The construction of the known apparata shows generally the intention to limit the space and especially the basic surface required. This aim follows from the fact that the basic surface of the apparata should be decreased in order to make possible their use in rooms of limited area. Another aim is to limit the amount of chemicals needed during processing, i.e. to develop as much photographic material as possible by the use of a given amount of chemicals. In order to save space and ensure the best conditions of development, the rolls are arranged with horizontal axes during work for fitting and forwarding the photographic materials. A device of the above-described construction is shown e.g. in the West-German Laid-Open Patent Publication DE-AS No. 27 40 650, FIG. 1 of which is a schematic view of a vertically arranged module. The module comprises passing rolls arranged along three vertical columns and includes a reversing roll beneath the level of the two extreme columns in the lower part of the module. The input and the output of the module can be connected to a forwarding unit comprising a forwarding roll. The forwarding unit serves for leading the photographic material to be developed from one module to the other and for carrying out, if desired, chemical or other operations which may take place in a relatively short time. The modules are arranged so that they comprise the forwarding units between each pair of modules. This means that an apparatus for developing color photography materials—it should contain generally three modules—has the width of three modules and two forwarding units at least.

SUMMARY OF THE INVENTION

The present invention is directed to a phototechnical apparatus of vertical arrangement for continuous development of different photographic materials, whereby the desired phototechnical operations can be carried out in a manner that saves space and chemicals. The invention is based on the recognition that the modules need not be separated from each other and that they comprise much unused space which can be put to good use by advantageous arrangement of the passing rolls.

According to the invention in a photographic apparatus of vertical arrangement, comprising an input terminal and an output terminal, with at least two vertically arranged modules therebetween and forwarding units connecting the modules, wherein each module includes passing rolls arranged along three vertical columns, the passing rolls being arranged with horizontal rotational axes, it is a very useful improvement to arrange the modules adjacent to one another and to design them with suitable walls wherein the walls in both adjacent modules cross the line tangential to the passing rolls arranged in the columns separated by the wall, wherein each crossing occurs between a pair of passing rolls.

An advantageous embodiment of the invented apparatus comprises walls made of regular shaped segments, wherein in manufacture it is especially useful to select rectangular or circular shapes.

The modules can be joined into one unit by segments with concave parts whereby a self-supporting construction can be realized. The segments constitute generally a wall of homogeneous material.

It is especially desired to choose the shape of the wall in such a way that the wall extends into the other module to a depth reaching at least the line connecting the axes of the passing rolls in the extreme columns, whereby it is possible to have considerable space savings.

For space savings it is advantageous to arrange a forwarding roll over the passing rolls in the forwarding unit, the rotational axis of which is between the planes covering the passing rolls in the adjacent columns of two modules separated by the wall of desired shape.

The passing rolls can be arranged by threes in parallel horizontal planes or by fours in two rectangular planes with axes defining a parallelepiped being rectangular to the axes. Another possibility is to arrange them by fives wherein a central roll is connected to four rolls arranged in two parallel planes.

If there were a spacing in the central column of passing rolls because of the wall projection into the space between the passing rolls of the extreme columns, it is of advantage to arrange therein means for filling up these spacings which can be exploited for batching, circulating chemicals or water, or reacting substances needed e.g. for flushing the inner space of the modules.

It is possible to diminish or stop the evaporation from the inner spaces of the modules when the modules are equipped with an upper conduit connecting their inputs and outputs whereby air is sucked away.

The apparatus according to the invention can be prepared with a shape saving much space and rendering a safe construction possible.

BRIEF DESCRIPTION OF THE DRAWINGS

The invention will be described in more detail by way of example and with reference to preferred embodiments shown in the accompanying drawings, wherein.

DESCRIPTION OF THE PREFERRED EMBODIMENTS

Figure 1:
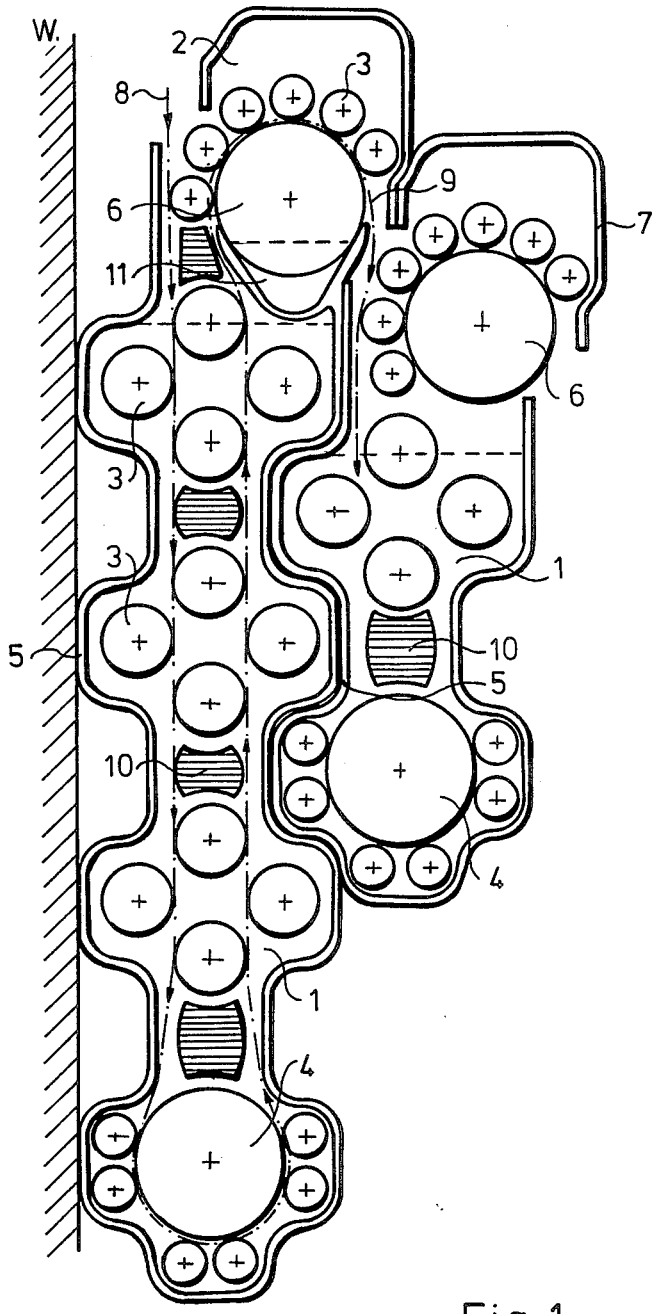
FIG. 1 is a sectional view of a preferred complete module of the invented apparatus with an adjacent module.

The phototechnical apparatus according to the invention (FIG. 1) consists of modules 1 and is equipped with different means for actuating movable elements, batching and recirculating chemical substances, water etc. (not shown in the drawings). The modules 1 comprise in their upper part a forwarding unit 2 connecting the modules to one another in series. In the inner space of the modules 1 there are passing rolls 3, arranged generally in three vertical columns, along respective vertical planes. The rotational axes of the passing rolls 3 are horizontal and they define in each column a surface which may be a straight plane, however, it can consist of inclined planes, too. In a module 1 there can of course also be an odd number of columns of the passing rolls, if desired. A reversing roll 4 is arranged in the lower part of the module 1 for connecting the extreme two columns of the three mentioned columns. A similar reversing roll 4 can be arranged beneath each further pair of extreme columns of passing rolls 3. The reversing roll 4 is surrounded in a known way by passing rolls 3 which are of smaller diameter than the passing rolls 3 in the inner space of the module 1. They are capable of pressing the photographic material to be developed to the outer surface of the reversing roll 4.

Figure 2:
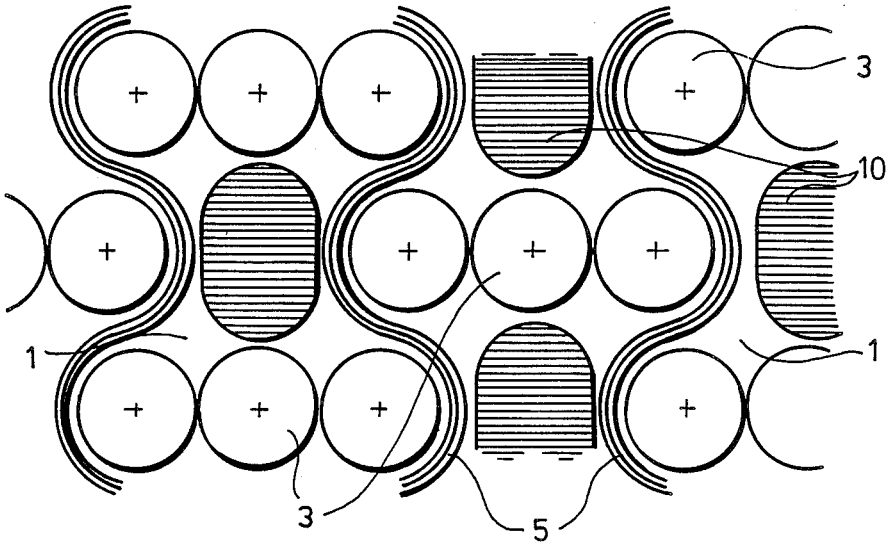
FIG. 2 is a partial sectional view of a module with concave self-supporting wall configuration and with passing rolls arranged by threes in the inner space.
Figure 3:
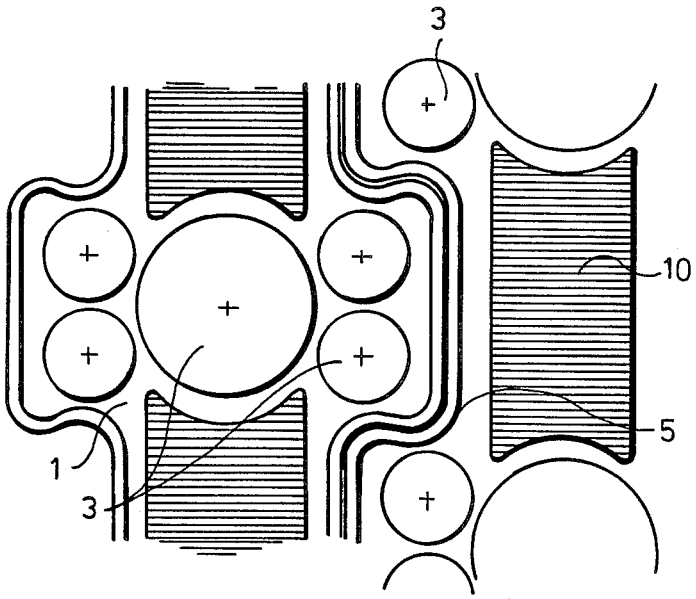
FIG. 3 is a partial sectional view of a module with a wave-form wall having passing rolls arranged by fives with axes in three parallel vertical planes.

The essence of the invention is to equip the modules 1 with a wall 5 which is not straight as in the art. The modules 1 have walls 5 ensuring the conformability of adjacent modules. This means that the wall 5 instead of separating the modules along a straight plane, is wave-shaped or rectangular-shaped, or has a cross section of another favorable shape, as shown in FIGS. 1, 2 and 3. The wall 5 can be concave curved, i.e. ensures a self-supporting construction of the apparatus (FIG. 2). The wall 5 is advantageously shaped with dimensions such that it extends at least to the depth of the plane defined by the rotational axes of passing rolls 3 arranged in the extreme columns. This means that the passing rolls 3 arranged in two adjacent modules 1 along the wall 5 separating them are situated between two planes spaced by a distance less than the sum of the diameters of two adjacent passing rolls 3 separated by the wall 5. These two planes can define the location of a forwarding roll 6 arranged over the columns determining the aforementioned planes. It is advantageous, of course, to select for the forwarding roll 6 a shape whereby the photographic material can be passed from a module 1 to another module without causing any demage to the material.

As mentioned above, the wall 5 of the module 1 can be made of e.g. circular segments, rectangular shaped segments with roundings or concave elements whereby the modules 1 support one another. Experience shows that it is very advantageous to prepare walls with parallel surface elements. In this case the modules 1 can be joined easily into an apparatus.

The module 1 is advantageously covered by a closing element 7 arranged over the forwarding roll 6 and defining an input 8 and an output 9. The advantage of this arrangement is the possibility of having a conduit over the closing element 7 wherein an air stream can be realized for limiting the evaporation of chemical compounds filling the modules 1.

The horizontal rotational axes of the passing rolls 3 can be arranged in the modules 1 in one plane, two planes and three planes. One plane is sufficient for placing the rolls by threes, two perpendicular planes serve for placing them by fours and three parallel planes serve for placing rolls by fives. This can be easily seen in FIGS. 1, 2 and 3. The passing rolls 3 define in each case three columns, wherein the middle column comprises empty spaces which can be filled by means 10, which are capable of occupying the empty spaces and of conducting different liquids needed during work. They can serve for recirculation also.

In the module 1 the reversing roll 4 together with the accompanying passing rolls 3 and the threes, fours or fives of the passing rolls 3 forming a part of the three columns advantageously constitute replaceable units which can be placed in different parts of the module 1. In this case modules 1 of equal length can form the apparatus according to the invention. If it were desired, of course, modules of different lengths can be used, too. By selectively placing the reversing roll 4, the length of the path of travel of the photographic material, i.e. the length of the active part of the module 1, can be regulated according to the requirements. This means that the module 1 can consist of parts of equal inner dimensions for receiving the passing rolls 3 arranged with or without the forwarding roll 4.

Of course, other embodiments can also be realized. The given embodiment forming an apparatus according to the invention depends on the requirements of the development, wherein the dimensions of the rolls should be selected according to the features of the photographic material to be developed.

In a module 1 it can be advantageous to prepare a part with dimensions equal or not to those of the parts receiving the rolls, wherein means for regulating the quantity of liquids filling the inner space can be displaced.

The walls and the forwarding elements of the apparatus according to the invention can be made of plastics or light metal. Therefore they can be manufactured with relatively small dimensions. The apparatus made according to the features shown above can be hung e.g. on a wall (FIG. 1) of a small room, such as a bath-room of a small flat. It can be connected according to well-known principles to a water supplying unit and to an electric network and actuated easily. These features are obvious and form no subject of this invention.

From the above description, it should be understood that many different-shaped walls equivalent to those shown above will be within the scope of the claimed invention and such shapes will depend on the materials used and the given circumstances.

I claim:

1. In a phototechnical apparatus for continuous development of photographic materials, comprising first and second development units arranged in series between an input and an output and a forwarding unit arranged between said first and second development units for forwarding photographic materials from said first development unit to said second development unit, each of said development units including a plurality of passing rolls arranged in first, second and third columns parallel to a first axis and a reversing roll arranged at the end of said columns of passing rolls for reversing the direction of travel of the photographic materials, the third column of passing rolls of said first development unit being arranged adjacent to the first column of passing rolls of said second development unit, and the third column of said first development unit and the first column of said second development unit being separated by a wall, the improvement wherein said wall has an undulating cross section such that said wall intersects a plane tangent to adjacent passing rolls of said third column of said first development unit and a plane tangent to adjacent passing rolls of said first column of said second development unit.

2. The phototechnical apparatus as defined in claim 1, wherein said wall extends at least from a plane through the rotational axes of adjacent passing rolls of said third column of said first development unit to a plane through the rotational axes of adjacent passing rolls of said first column of said second development unit.

3. The phototechnical apparatus as defined in claim 1, wherein said wall comprises surface elements having circular cross sections.

4. The phototechnical apparatus as defined in claim 1, wherein said wall comprises surface elements having rounded rectangular cross sections.

5. The phototechnical apparatus as defined in claim 1, wherein said wall comprises surface elements having concave cross sections.

6. The phototechnical apparatus as defined in claim 1, wherein said wall is made of injection-molded plastic material.

7. The phototechnical apparatus as defined in claim 1, wherein said forwarding unit comprises a forwarding roll having a rotational axis lying between first and second vertical planes which respectively pass through the rotational axis of a passing roll of said third column of said first development unit and the rotational axis of a passing roll of said first column of said second development unit.

8. The phototechnical apparatus as defined in claim 1, wherein said first and second development units have passing rolls arranged in groups of three wherein the rotational axes of each passing roll in a group of three lie in a common horizontal plane, the common horizontal planes of all groups of three being substantially parallel.

9. The phototechnical apparatus as defined in claim 1, wherein said first and second development units have passing rolls arranged in groups of four, wherein the rotational axes of each passing roll in a group of four are substantially parallel, the rotational axes of two passing rolls in a group of four lying in a common horizontal plane and the rotational axes of the other two passing rolls of said group of four lying in a common vertical plane.

10. The phototechnical apparatus as defined in claim 1, wherein said first and second development units have passing rolls arranged in groups of five, wherein the rotational axes of the passing rolls in a group of five lie in one of three vertical planes, including first and second vertical planes and a third vertical plane therebetween, the rotational axes of the first and second passing rolls of said group of five lying in said first vertical plane, the rotational axes of the third and fourth passing rolls of said group of five lying in said second vertical plane, and the rotational axis of the fifth passing roll lying in said third vertical plane.

11. The phototechnical apparatus as defined in claim 1, wherein said first and second development units further comprise means for filling the spaces located between the passing rolls in said second columns.

12. The phototechnical apparatus as defined in claim 11, wherein said means has inlet and outlet means for respectively admitting and discharging liquids incorporated therein.

13. The phototechnical apparatus as defined in claim 1, wherein said first and second development units respectively further comprise means for regulating the quantity of liquids used for developing.

14. The phototechnical apparatus as defined in claim 1, wherein said first and second development units are formed as separable modules and are connected by said wall.

* * * * *